US005382449A

United States Patent [19]

Hedges

[11] Patent Number: 5,382,449

[45] Date of Patent: Jan. 17, 1995

[54] METHOD OF USING VOLCANIC ASH TO MAINTAIN SEPARATION BETWEEN ASPHALT ROOFING SHINGLES

[76] Inventor: Kenneth B. Hedges, 1207 N. Hersey, Beloit, Kans. 67420

[21] Appl. No.: 143,923

[22] Filed: Oct. 27, 1993

[51] Int. Cl.[6] ..... B05D 1/12

[52] U.S. Cl. ..... 427/187; 427/186; 428/149

[58] Field of Search ..... 427/186, 187, 188, 204; 428/149, 150

[56] References Cited

U.S. PATENT DOCUMENTS 2,043,545 6/1936 Kirschbraun ..... 427/187
2,553,413 5/1951 Higgs ..... 427/186

*Primary Examiner*—Terry J. Owens
*Attorney, Agent, or Firm*—Richard P. Stitt

[57] ABSTRACT

Volcanic ash is applied to hot asphalt roofing shingles during manufacture to maintain separation and inhibit color transfer between the shingles when stacked. Volcanic ash is separated into a fine particulate component which is a respirable dust and a remainder separating agent component which can be handled without respiratory equipment. After a roofing shingle core material such as an organic film or fiberglass sheet has been dipped into hot asphalt and colored roofing granules have been applied to one side of the hot asphalt-coated core material, the separating agent component is applied by spraying or gravity feed through a perforated plate to the opposite side of the hot asphalt-coated core material.

9 Claims, No Drawings

METHOD OF USING VOLCANIC ASH TO MAINTAIN SEPARATION BETWEEN ASPHALT ROOFING SHINGLES

BACKGROUND OF THE INVENTION

This invention relates to the manufacture of asphalt roofing shingle pieces, and in particular, the use of processed volcanic ash to maintain separation of the finished roofing shingles and prevent the transfer of shingle coloring agents from one shingle to another.

Asphalt roofing shingles are composed of an organic material base or fiberglass core to which a coating of hot asphalt is applied. Different colored shingles are made by coating the hot asphalt covered core with a coloring agent. The shingles are cooled in a stream of water and cut into the desired shingle shape. This results in an asphalt shingle which can then be applied to a roof. One problem with this basic construction process is the tendency of the finished shingles to adhere together under heat or pressure. This can result in multiple shingles being glued together by the asphalt. These shingles may not be separable without causing damage to the shingles.

Asphalt roofing shingles, after manufacture, are generally packaged into 33 square foot units weighing more than 70 pounds. These packages of shingles are stacked onto pallets for shipping. If the shingles are shipped by railroad, one pallet is commonly stacked on another to fill the railroad car. This packaging, palleting and shipping produces substantial pressure on the shingles and can result in the asphalt coating adhering to adjoining shingles. The shingles also can be affected by high temperatures found in shipping containers during warm weather. Temperatures of 150° degrees Fahrenheit can be attained in a railroad shipping car during warm whether.

The coloring of the asphalt shingle is applied to the upper surface of the shingle by spraying color nodules on to the surface of the hot asphalt. This color, however, is susceptible to transferring to the bottom of the adjoining shingle during the above-described pressure and high temperature found in the shipping of the shingles.

Therefore, it is necessary to include a separating or parting agent on the finished shingles in order to keep the finished shingles separate from one another and to prevent color transfer from one shingle to the adjoining shingle. The ideal separating or parting agent would be inexpensive, exhibit 100% adhesion to the hot asphalt, be resistant to removal during water cooling of the hot asphalt, not contribute any respirable dust to the work place atmosphere, and not dull the knives used to cut the asphalt material into shapes.

A number of agents commonly have been used to accomplish separation of asphalt roofing shingles among these are talc, mica-containing material and crystalline silica or sand. While each of these agents is capable of providing separation of asphalt shingles, they each present a several undesirable characteristics in varying degrees. These drawbacks include cost, poor color transfer prevention, dulling of cutting knives, work place pollution, and respirable dust danger.

Talc, a form of hydrous magnesium silicate ($Mg_3SiO_{10}(OH)_2$, is usually the main constituent of mixtures offered commercially as talc. Talc is relatively expensive with respect to the other separating agents. However, the effectiveness of talc in maintaining color separation has been found to diminish significantly over a two week period when subjected to train box-car storage conditions of approximately 150° F. and the pressures developed in a two pallet-high roofing shingle stack. Talc also creates a significant dust and pollution problem. When talc is sprayed on the hot asphalt shingle, only a portion of the talc achieves contact with the asphalt and a portion falls away onto the floor of the manufacturing site. This necessitates that workers be assigned to the cleanup of the talc from the floor. It is not uncommon for this task to require two full-time workers for a shingle plant. Talc also becomes airborne during spraying and cleanup. The presence of airborne talc requires that workers wear respiratory equipment as the threshold limit value (TLV) for talc is 2 mg talc per cubic meter of air under OSHA and Mine Safety and Health Administration regulations. Finally, talc is washed from the shingles during the water cooling process and mixes with the wash water. The talc polluted wash water must then be collected in ponds or tanks to allow the talc to settle-out before reuse or discharge of the cooling water. The talc must be collected from the ponds or tanks and carted to a waste site. Thus the cost of using talc to maintain shingle separation is further increased by the related industrial hygiene costs of talc. The advantage to talc is its softness which minimizes dulling of the shingle-cutting knife blades. Dulling of these blades and their replacements is costly as the shingle line must be stopped while the blades are removed and replaced.

An alternative separation product is sand, a form of crystalline silica. The sand is dried and screened and then sprayed on to the hot asphalt shingles before cooling. Sand is subject to many of the same industrial hygiene problems and associated costs as talc. Sand is initially cheaper to purchase, however, it also falls off from the shingles after it is applied and washes off during the water cooling process. This results in the need to clean sand from the floors and to clean cooling water and water holding ponds and tanks. The cleanup and application of sand can also inject respirable crystalline silica into the work atmosphere. This may require workers to wear respirators as crystalline silica is a Class A carcinogen. Sand also is extremely hard on the shingle cutting blades. Use of sand as a parting agent results in cutting blade replacement approximately 15 times more frequently than talc.

Another alternative is to use micaceous material as the parting agent. This material also presents the dust problems of talc and sand and the polluting of the cooling water. Micaceous materials also dull the shingle cutting knives and necessitates blade replacement approximately eight times as often as when talc is used as the parting agent.

SUMMARY OF THE INVENTION

It is a principal object of the present invention to provide a nontoxic separating agent for asphalt roofing shingles which may be sprayed onto the surface of shingles during manufacture.

Another object of the invention is to provide an asphalt shingle separating agent having a cost per square foot of shingle produced which is less that conventional shingle separating agents.

Yet another object of the invention is to provide a separating agent having greater adherence properties and thereby reducing the amount of separating agent waste which must by removed from the manufacturing area and discarded.

Still another object of the invention is to provide a separating or parting agent which reduces dulling of knife blades used in cutting asphalt shingles.

Another object of the invention is to provide a separating agent for asphalt roofing shingle production which reduces loss of the applied separating agent during cooling of the shingles and thereby reduces the contamination of fluid cooling agents.

Yet another object of the invention is to provide a separating agent which reduces or eliminates the need for workers to wear protective breathing apparatus while working with the parting or separating agent.

In summary the invention includes a compound and process for maintaining separation between two or more asphalt roofing shingles which also inhibits the transfer of coloring between the shingles and comprises providing volcanic ash, drying the volcanic ash to substantially eliminate the moisture between volcanic ash particles, separating the dry ash into a first fine particulate component and a second remainder component, and then applying the suspended remainder component onto a hot asphalt roofing shingle to maintain separation between asphalt roofing shingles and to inhibit the transfer of color between the shingles.

A dust retarding agent also may be added to the volcanic ash of the invention. One suitable dust retarding agent is calcium chloride which is compounded with the volcanic ash at a concentration of approximately 40 to 100 parts per million.

The foregoing and other objects are not intended in a limiting sense, and will be readily evident upon a study of the following specification.

DETAILED DESCRIPTION OF A PREFERRED EMBODIMENT

Volcanic ash ore is a form of amorphous silica and other oxide components including aluminum oxide, potassium oxide, calcium oxide, ferrous and ferric oxides, as well as others. Volcanic ash is mined from ground deposits and appears as a generally fine granular material of various colors. The ash utilized in a preferred embodiment of the invention is a white colored material. Volcanic ash is a subcategory of the airborne fragments released during a volcanic eruption. These airborne fragments are generally known as tephra. Volcanic ash is that type of tephra having a particle size of less than 2 millimeters. The volcanic ash used in a preferred embodiment of the invention presents a particle size of less than 0.6 mm and is preferred as this eliminates sizing of the ash for it intended purpose.

The ash ore is loaded into a rotating dryer to substantially eliminate water in the ore. The heating is sufficient to remove water which is between the particles the ash ore, but not so high as to cause expansion of the internal water captured within the ash particles as this would result in expansion and bursting of the ash particles. A drying temperature of 250° F. is satisfactory to dry the surface of the ash.

During the drying procedure a dust retarding agent may be added to control the release of airborne fine particles of the volcanic ash during its later use. One such dust retarding agent is an aqueous solution of calcium chloride which is added into the rotating dryer to accomplish mixing of the calcium chloride solution with the volcanic ash and drying of the mixture. It is sufficient if the calcium chloride concentration is between approximately 40 to 1000 part per million. A 50 ppm concentration can be achieved by the addition of one pound of calcium chloride to 10 tons of volcanic ash. The calcium chloride is dissolved water which is then added into the dryer with the volcanic ash.

The dried ash is then removed from the dryer and transferred to a cyclonic action separator to remove fine particulate components amounting to approximately 8% of the total weight of the ash. It is important to remove particles of less than 5 microns as this size particle is a principal constituent of respirable dust which is considered a health hazard by various governmental agencies. The remaining ash component is then utilized for spraying onto the asphalt shingles as is described herein. The cyclonic separator is of the standard type which establishes a cyclonic air current. The air at the center of the cyclone moves upwardly to exit the separator. This upwardly moving center column of air, known as the riser, lifts the smaller size particles out of the separator while the larger particles remain within separator. To accomplish removal of fine particles which could be released as respirable dust, the air velocity of the riser is established at approximately 1800 feet per minute. The fine particles component of the volcanic ash is bagged separately and the larger remainder component of the volcanic ash is used as the parting or separating agent for the asphalt shingles.

The volcanic ash is applied as a parting agent to asphalt shingles after the organic film base or fiberglass base material of the shingle has been dipped in the hot asphalt bath and the color containing granules are applied to the top surface of the material. The bottom surface of the asphalt then receives the volcanic ash remainder component. The ash may be sprayed onto the asphalt surface or the ash may be applied by allowing the ash to gravity feed through a perforated plate under which the asphalt passes. Typically with the prior parting agents, a substantial portion of the sprayed parting agent falls away from the asphalt and onto the floor of the shingle plant. This requires personnel to clean up this material. In addition, the spraying of the talc or sand materials tends to introduce respirable materials into the air which are categorized a health hazards by OSHA and the Mine Safety and Health Administration.

Each of these problems is substantially eliminated utilizing the inventive parting agent. The volcanic ash parting agent has nearly 100% adhesion to the hot asphalt. This eliminates the need for constant clean-up of the parting agent application area. The inventive volcanic ash parting agent also eliminates the need for workers to wear respiratory equipment due to fine dust particles from the parting agent.

The amount of volcanic ash which is introduced into the work place atmosphere when it is applied as a parting agent is sufficiently low that the Mine Safety and Health Administration has found the respirable air content to be zero at work stations. This is an important distinction over the prior separating materials such as crystalline silica which has been identified as a Class A carcinogen. Sand is almost 100% crystalline silica and the fine silica dust generated from sweeping the floor residue and the particles introduced into the air during spraying-on of the sand creates a health risk not found in volcanic ash. Volcanic ash is an amorphous silica structure, rather than a crystalline silica structure, and such amorphous silica structure is not classified as a carcinogen. Talc presents a quite low threshold limit value of 2 mg per cubic meter of air. Therefore, it may be necessary for workers to wear filtering and breathing equipment when using talc parting agents. Such breathing apparatus is unnecessary with the inventive volcanic ash parting agent.

The sheet of prepared asphalt shingle material is next cooled by spraying water onto both surfaces of the asphalt covered sheet. This procedure cools the asphalt, but also tends to wash off some of the color granules and a portion of the prior separating or parting agents such as talc, or crystalline silica. However the volcanic ash parting agent maintains significantly better adhesion with the asphalt and substantially reduces the wash-off of volcanic parting agent into the cooling water. This reduction in the amount of parting agent that is removed by the cooling water improves the process by maintaining the cooling water in a cleaner state, by reducing the need for cleaning of water cooling tanks and ponds, reducing the number of personnel needed for such tasks, and by reducing the quantity of parting or separating agent which must be applied to the asphalt shingle in order provide sufficient remaining parting agent on the shingle after the water cooling step. This lowers costs by reducing the amount of parting agent wasted and the cost of cleaning of cooling water and water reservoirs.

The cooled shingle is then cut into individual roof shingles. This aspect of the process is also improved as the inventive volcanic ash parting agent does not dull the cutting blades as rapidly as sand or micaceous materials. The parting agent causing the least damage to the cutting blades is talc, next is the inventive volcanic ash parting agent followed by micaceous materials and last is sand. For example, when sand is used as a parting agent the cutting blades must be replaced approximately fifteen times more often as with talc. When micaceous material is used as the parting agent this replacement frequency falls to approximately eight times that of talc. However, with volcanic ash the frequency of replacement falls to approximately 1.5 time that of talc. This extension of the life of the shingle cutting blades is attributed to the shape characteristics of the volcanic ash. The ash tends to have a comparatively flat particle shape. Therefore, when lodged in the asphalt, the volcanic ash particle is likely to be on edge or flat against the asphalt. Upon cutting the shingle, the blade is unlikely to contact those particles having an on-edge orientation, and the remaining particles in the flat orientation tend to break under the knife force. This reduces the damage to the knife blade during each cut and extends the usable life of the blade.

Finally, the inventive volcanic ash parting agent improves resistance to color transfer from one shingle to the next. In this regard the volcanic ash surpasses all other parting agents and talc in particular.

Certain changes may be made in embodying the above invention, and in the construction thereof, without departing from the spirit and scope of the invention. It is intended that all matter contained in the above description shall be interpreted as illustrative and is not meant in a limiting sense.

It is also to be understood that the following claims are intended to cover all of the generic and specific features of the invention herein described, and all statements of the scope of the invention which, as a matter of language, might be said to fall therebetween. Particularly, it is to be understood that in the claims ingredients or compounds recited are intended to include compatible mixtures of such ingredients.

I claim:

1. A process for maintaining separation between stacked asphalt roofing shingles and inhibiting transfer of coloring between the stacked shingles comprising the steps of:

providing volcanic ash, drying said volcanic ash to substantially eliminate moisture between volcanic ash particles, separating the dry ash into a first fine particulate component and a second remainder component, and applying said remainder component onto each of a plurality of hot asphalt roofing shingles sufficiently to maintain separation and inhibit the transfer of color between the shingles when stacked.

2. The process as claimed in claim 1 further comprising the step of mixing a calcium chloride dust retarding agent with said volcanic ash to reduce evolution of volcanic ash dust during said applying of said remainder component.

3. The process as claimed in claim 2 wherein said calcium chloride dust retarding agent is mixed with said ash in a concentration of less than approximately 1000 parts per million of volcanic ash, said agent being added to the volcanic ash prior to drying.

4. The process as claimed in claim 1 wherein said separating step comprises subjecting said volcanic ash to a cyclonic action to achieve separation of said volcanic ash into said fine component and said remainder component.

5. The process as claimed in claim 1, wherein said applying step comprises suspending said remainder component in a stream of air and spraying said suspended remainder component onto each of said hot asphalt roofing shingles.

6. An improvement in the method of production of asphalt roofing shingles where a core material is coated with asphalt and a first surface is covered with colored granules and a second surface is sprayed with a separating agent, the improvement comprising:

selecting volcanic ash as said separating agent, sizing said volcanic ash to provide a first fine particulate component and a second remainder separating agent component, and spraying said second remainder separating agent component onto said second surface.

7. The process as claimed in claim 6 wherein said volcanic ash is mixed with a calcium chloride dust retarding agent to reduce evolution of volcanic ash dust during said spraying of the separating agent.

8. The agent as claimed in claim 7 wherein said calcium chloride dust retarding agent is in a concentration of less than 1000 parts per million of volcanic ash, said agent being mixed with said volcanic ash prior to drying.

9. The process as claimed in claim 6 wherein said volcanic ash is sized by use of cyclonic action to achieve separation of said volcanic ash into said fine component and said remainder component.

* * * * *